United States Patent [19]

Wallstén

[11] Patent Number: 4,600,599

[45] Date of Patent: Jul. 15, 1986

[54] METHOD OF APPLYING A WEAR-RESISTANT COATING ON A THIN, METALLIC STRIP-SHAPED CARRIER MATERIAL

[75] Inventor: Hans I. Wallstén, Denans, Switzerland

[73] Assignee: Inventing S.A., Switzerland

[21] Appl. No.: 541,102

[22] Filed: Oct. 12, 1983

[30] Foreign Application Priority Data

Oct. 13, 1982 [SE] Sweden ..... 8205806

[51] Int. Cl.[4] ..... B05D 1/02; B05D 1/08; B05D 3/12; B05D 5/00

[52] U.S. Cl. ..... 427/34; 427/178; 427/275; 427/279; 427/284; 427/286; 427/287; 427/289; 427/292; 427/359; 427/360; 427/398.2; 427/398.3; 427/398.5; 427/423; 427/424

[58] Field of Search ..... 427/34, 424, 398.2, 427/398.3, 398.5, 289, 292, 284, 178, 275, 279, 286, 287, 359, 360, 423

[56] References Cited

U.S. PATENT DOCUMENTS 2,862,837 12/1958 Brennan ..... 118/325 X
4,100,881 7/1978 d'Andréa ..... 427/398.5 X

FOREIGN PATENT DOCUMENTS 978988 1/1965 United Kingdom .
1289609 9/1972 United Kingdom .

*Primary Examiner*—Evan K. Lawrence
*Attorney, Agent, or Firm*—Ostrolenk, Faber, Gerb & Soffen

[57] ABSTRACT

There is disclosed a method of and apparatus for producing a wear-resistant coating on a thin metallic strip, for example for the manufacture of coating scrapers for paper webs. After preparatory surface treatment the strip is passed longitudinally through a coating zone in which coating material in a molten state is sprayed onto the strip by a coating unit as the strip passes. The wear-resistant coating is built up in steps by the application of several coating layers one on top of the other, each being applied during a respective pass of the strip through the coating zone. The strip speed and the capacity of the coating unit are adjusted in relation to each other so that the heat supplied to the carrier material by each coating layer applied will be so slight in relation to the thermal capacity of the carrier material that the temperature increase in the carrier material does not cause any change in the physical properties of the carrier material. After each pass of the strip, the strip is caused or allowed to cool so that the heat applied to the carrier material by the spraying on of each layer of coating is substantially removed therefrom before a new coating layer is applied. In a preferred method the strip is fed from one reel, over a roller to pass the coating unit, to be taken up on another reel and the apparatus is reversed after each pass so that the strip passes back and forth through the coating zone for successive coating steps.

22 Claims, 8 Drawing Figures

METHOD OF APPLYING A WEAR-RESISTANT COATING ON A THIN, METALLIC STRIP-SHAPED CARRIER MATERIAL

BACKGROUND OF INVENTION

The present invention relates to a method of applying a wear-resistant coating to a strip of metallic carrier material, for example in the manufacture of scrapers, blades and the like.

The invention is of particular, but not exclusive utility in the manufacture of scrapers, blades and the like, particularly coating and smoothing scrapers for moving paper webs.

Developments in paper-coating technology tend towards coating plants with higher and higher production rates. Plants exist today with paper web speeds of up to 1500 m/min. and more, the width of the paper web sometimes being as much as 8 meters or more. Such plants demand great precision of the doctor used for such coating particularly since the quantity of coating composition applied is usually not moe than 5–25 g/m$^2$ paper surface. In this field it is important that the layer of coating composition on the paper web must be perfectly uniform.

The coating result of such a coating plant is affected to a great extent by the length of the blade bevel in the direction of travel of the web in relation to the spring force applied on the flexible blade. The surface pressure applied, i.e. the pressure per unit surface area exerted via the bevel on the surface of the paper, known as the specific surface pressure, has decisive significance on the quantity of coating composition remaining on the web. A specific ratio therefore prevails between the extent of the bevel and the yielding properties of the blade. To prevent changes in the extent of the bevel surface due to wear during the coating process, therefore, such coating blades are now normally pre-ground to ensure a bevel extent and bevel angle which correspond as closely as possible to the actual conditions prevailing during the coating process itself. It is also important that the flexibility of the blade is adjusted to the prevailing spring force so that the blade will adjust to an uneveness in the web and also allow through defects such as lumps or thicker patchs in the paper web.

Conventional doctor blades give a good coating result, but they have the drawback of being subject to rapid and uneven wear and must therefore be replaced after only a small part of the blade material has become worn. This is because, for practical reasons, the coating blade, which generally cooperates with one side of the coated paper web and a rubber-clad support roller carrying the other side of the paper web, is wider than the paper web. Furthermore, pigment dispersions of clay in water are usually used for coating paper, which means that both the coating composition and the paper web itself have an extremely abrasive effect on the edge of the blade. On the other hand, those parts of the blades located beyond the paper web and thus merely in contact with the rubber-clad support roller during the coating process, are subjected to negligible wear. This means that the edge of the blade, initially straight, will become worn and somewhat concave along the sections where the paper web runs and after a while the coating across the web will become uneven. In practice, therefore, conventional blades must be replaced after only a few hours of use. This is expensive, not only from the material point of view, but also because it incurs expensive shut-downs followed by new running-in periods.

A great deal of work has been put into endeavours to increase the service life of conventional coating blades and the properties of the traditional blade have been optimized by a suitable choice of steel composition and by treatments such as annealing.

In theory, it might be possible to increase the service life of such a coating blade by using a blade material which in itself is more wear-resistant than the conventional spring-steel. Materials apparently suitable, such as hard metals and cermets, are not always sufficiently flexible. Indeed such materials are often extremely brittle and would therefore break easily due to the stresses normally occurring from time to time in use of a doctor blade.

In technical fields other than coating, attempts have previously been made to solve wear problems by attaching pieces or strips of more wear-resistant material to the carrier material used. Hard chromium plating or plating with some other metal has also been suggested as a means of giving inherently soft carrier materials a better wearing surface. Extensive experiments carried out to solve the problem of wear in doctor blades in similar ways have been unsuccessful with the thin coating blades used in paper manufacture. These known solutions proved difficult to implement from the technical point of view with the thin blade material used and it was also found that the desirable properties of the thin basic blade material, such as flexibility, necessary for good coating results, were considerably detracted from by the measures adopted to improve wear-resistance. It is, of course, essential that a coating blade having an improved wear-resistance as compared with conventional blades should have not only a longer service life, but still give a perfectly satisfactory coating result, if it is to be adopted.

Such a result is not achieved if the flexibility and uniform surface of the blade decreases as a result of the measures adopted to increase wear-resistance.

SUMMARY OF THE INVENTION

It is an object of the present invention to provide a method of applying a wear-resistant coating to a strip of metallic carrier material, which method facilitates the manufacture of coating and scraper blades and the like having an improved wear-resistance and yet providing satisfactory results in use.

According to the invention, there is provided a method of applying a wear-resistant coating to a strip of metallic carrier material in which said wear-resistant coating is built up on said strip in a plurality of successive coating steps, in each of which the strip is passed longitudinally through a coating zone in a coating station, in which coating zone coating means in the coating station sprays continuously onto the strip a molten coating agent, which, when hardened, is wear-resistant and wherein the heat applied in each said step to the strip by spraying of the molten coating material thereon, is substantally removed from the strip before the next said coating step, and wherein the heat applied to the strip in each said coating step is so small, in relation to the heat capacity of the strip, that the temperature increase in the strip is insufficient to change the physical properties of the carrier material.

In a preferred embodiment of the method, a thin, flexible, metallic, strip having a maximum thickness of 2.0 mm is used and, after a preparatory surface treatment, is provided in steps, with a coating of wear-resistant material to a total thickness of at most, 0.35 mm.

Embodiments of the invention are described below, by way of example, with reference to the accompanying drawings.

DESCRIPTION OF PREFERRED EMBODIMENTS

Figure 1:
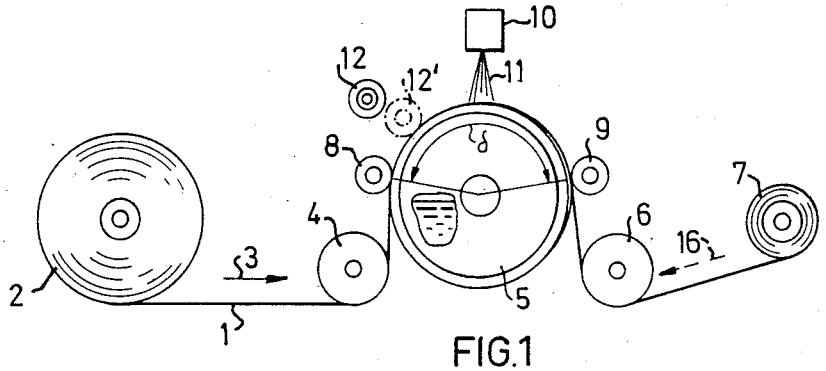
FIG. 1 is a diagrammatic side view of an apparatus embodying the invention for coating a metallic strip with wear-resistant material.

Referring to the drawings, FIG. 1 shows an apparatus for applying a wear-resistant coating on a strip 1 of metallic carrier material. If the equipment is to be used in the manufacture of flexible steel blades for paper coating, a carrier material is preferably used which has a thickness of 0.10–0.70 mm and a hardness of at least 22 Rockwell C. The carrier material is preferably a surface-tempered carbon steel of spring steel type with the following composition, for instance:

C—1.02%
Si—0.20%
Mn—0.40%
$P_{max}$—0.03%
$S_{max}$—0.025%

The strip 1 is initially passed from a reel 2 in the direction of the arrow 3 via a guide roller 4 to a rotating, journalled roller 5 and then via another guide roller 6 to a reel 7. The winding angle over the surface of the roller 5 is designated $\gamma$. If desired, the roller 5 may be water-cooled. The apparatus also comprises two drive rollers 8 and 9, arranged slightly above the guide rollers 4 and 6. These drive rollers 8, 9 are driven by suitable means such as air motors, adjustable with respect to speed and direction of rotation. A coating-spraying unit 10 is arranged at an adjustable distance above the roller, and a jet fascicle of molten coating material emitted by the unit is designated 11. Before the strip 1 is moved past the jet fascicle 11, it may be contacted by a surface-treating means 12, e.g. in the form of a rotating grinding wheel or steel brush which is arranged to be pressed with suitable force against the strip 1. Said surface-treating means is shown by the broken line 12' in its operative position, i.e. pressed against the strip.

It has been found preferable, in some cases, instead of careful grinding and/or brushing for the preparatory surface treatment, to use special blasting with carborundum powder or the like, preferably having a grain size of less than 0.2 mm. In this case the blasting should preferably be performed at an angle of at most 45° to the surface of the strip.

Figure 2:
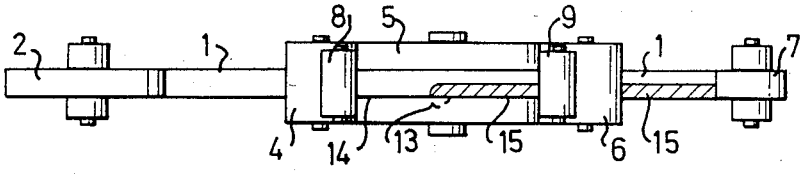
FIG. 2 is a view from above of the apparatus shown in FIG. 1.

FIG. 2 is a view from above of the apparatus FIG. 1 and for the sake of clarity the coating unit 10 has been omitted. The circular area designated 13 in FIG. 2 corresponds to the circular zone at the level of the strip below unit 10 over which coating material is sprayed from the spraying unit 10. The spraying unit 10 has been adjusted so that the zone 13 is located on the edge 14 of the strip 1. As the strip 1 is moved continuously longitudinally in the direction of the arrow 3, therefore, a layer of coating material is deposited along the hatched section 15 along one edge of the strip 1.

The apparatus shown in FIGS. 1 and 2 can also be run in the opposite direction, i.e. in the direction of the arrow 16. For the reasons set out below, it has been found advisable for the coating to be built up of several layers and in order to achieve this, therefore, a first coating layer is applied to the strip material as it passes the spraying unit 10 for the first time in the direction of the arrow 3, whereupon the direction of movement is reversed and a second layer is applied on top of the first layer already applied on the strip, by running the strip back to the reel 2 in the direction of the arrow 16. The strip-shaped material is thus run backwards and forwards between the reels 2 and 7 until the desired thickness of the coating has been achieved.

The wear-resistant coating is applied by a thermal spraying technique in which a molten coating material is sprayed against the surface to be coated. In the present case plasma or flame spraying are suitable methods. With plasma-spraying, preferable in many cases, a gas is heated so intensely by an arc that the gas achieves plasma state. In this plasma state the gas is sprayed from a nozzle in a jet and the material to be used for coating is supplied to the plasma jet in powder form by a carrier gas. The powder thus melts immediately and is thrown by the jet in molten state onto the surface to be coated. To avoid heat-damage on the extremely thin steel blade being coated, the coating, very thin in itself, is built up in steps, with the strip being cooled after each step.

Figure 3:
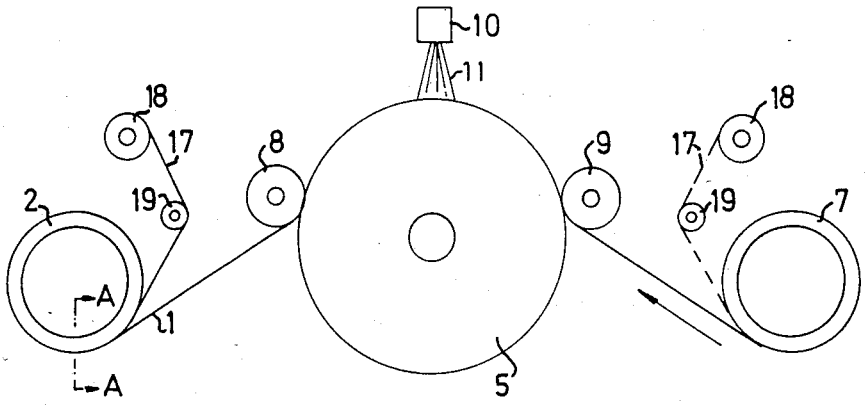
FIG. 3 is a diagrammatic side view of a variant of the apparatus of FIG. 1.

The apparatus shown schematically in FIG. 3 also comprises a rotatably journalled roller 5, reels 2 and 7, drive rollers 8 and 9 and metal-spraying unit 10 identical with those of FIGS. 1 and 2. To avoid problems in winding up the strip 1 as it is coated, some accessories, shown in FIG. 3, may be used. Since coating is only applied along one edge of the strip, problems arise when winding it onto the reels. In order to fill out the space on the uncoated part of the strip between two turns, therefore, a strip-shaped interlayer 17 of cardboard, for instance, is inserted between each turn of the strip-shaped carrier material 1 wound onto the reel and the adjacent turn. In the arrangement shown, a first length of material 17 is thus unwound and wound continuously from one reel 18, via a guide roller 19, and inserted and removed continuously between the winding turns on the reel 2 and a second length of material 17 is likewise wound and unwound continuously from another reel 18, via another guide roller 19 and removed and inserted repeatedly between the turns on reel 7.

The support roller 5 shown in FIGS. 1–3 may be omitted in certain cases. It is, however, important that the strip can be fed past the coating station in a controlled manner. The coating unit may even be laterally displaceable to enable special coating effects.

Figure 4:
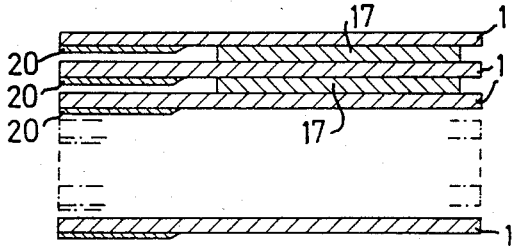
FIG. 4 is a view in section to an enlarged scale along the line A—A in FIG. 3.

FIG. 4 shows a section through winding turns of the strip material 1 wound in this manner together with an interlayer. The coating layer applied on one edge of the strip 1 is designated 20.

If the interlayer 17 is somewhat thicker, and considerably wider than the applied coating layer 20, the strip 1 will form a stable roll even though the part of the strip 1 with the coating 20 is unsupported. The interlayer 17 should preferably be located at some distance from the inner edge of the coating 20.

Figure 5:
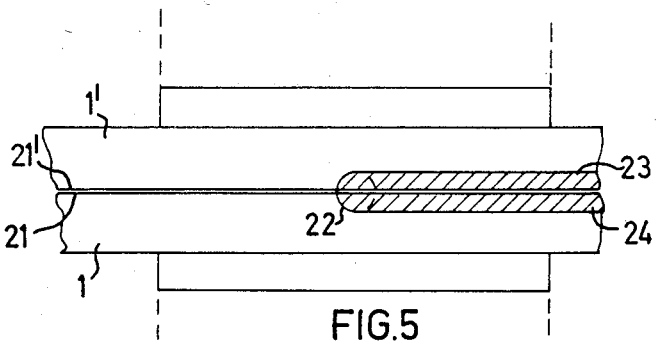
FIG. 5 is a diagrammatic view, from above, illustrating the use of a variant apparatus for simultaneously coating two strips.

FIG. 5 illustrates the operation of a variant apparatus, in which two strips of carrier material 1 and 1', respectively, with longitudinal edges 21, 21' facing each other and closely adjacent, are fed through a coating station with a layout in principle the same as the apparatus shown in FIGS. 1 and 2, with the upper surfaces of the strips lying in the same common cylindrical surface as one another. The circular coating zone obtained from the jet fascicle 11 of the coating unit 10 is here denoted 22 and the areas covered due to the movement of the strips 1, 1' are designated 23, 24, respectively. As can be seen, substantially the entire coating zone 22 is utilized here to produce coatings up to the edges 21, 21' or the strips 1, 1', respectively. This enables considerable savings in coating material to be achieved. The two-strip coating arrangement shown in FIG. 5 also offers a considerable increase in production.

In some cases the two-strip coating shown in FIG. 5 may influence a controlled guiding of the two abutting longitudinal edges of the strips.

According to one alternative embodiment of the present method a "two-strip" production in one and the same coating operation could be achieved in which method a single strip of carrier material having a greater width than that in FIG. 2 is provided with a wear-resistant coating over a longitudinal band extending down the middle of the strip. By subsequently cutting said strip along the coated mid-section two blade blanks are achieved.

Figure 6:
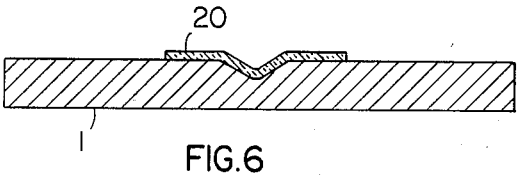
FIGS. 6 and 6A are cross-sectional views of a coated strip which has been used to simultaneously form two coated blades.
Figure 6A:
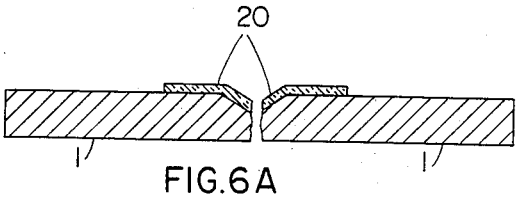

This "two-strip" process can be further improved by providing the carrier material initially—i.e. before the coating operation—with a substantially V-shaped longitudinal groove along its middle, whereafter the middle of the strip, including said longitudinally extending groove, is provided with said wear-resistant coating and the thus coated strip is thereafter cut along the bottom of said groove to provide two strips each coated on its upper planar surface as well as on an adjoining bevel surface extending to an edge, each bevel surface being a part of said V-groove. A cross section of the resultant strip is shown in FIG. 6.

In single-strip coating using a plasma unit, a nozzle is usually chosen which gives a coating width of about 5 mm. This means that the circular coating zone should have a diameter of about 8 mm if coating is to be obtained right out to the edge of the strip. Thus, with single-strip coating only about $\frac{2}{3}$ of the coating zone is used. If two strips are to be coated simultaneously as in FIG. 5, the nozzle of the coating unit is suitably exchanged for one giving a total coating zone of 10–12 mm. A coating width of about 5 mm is then obtained on each strip, entailing a considerable saving in material. If the same amount of heat is applied in both cases, the speed of travel of the strips will be the same but the production will be doubled since two strips are treated simultaneously.

If the desired width of the coating zone is greater than the diameter of the circular spray zone 13 or 22, a lateral displacement of the coating unit with respect to the strip-shaped material can be performed when the direction of feed of the strip material is reversed, so that the coating is built up on opposite sides of the coating zone alternately.

In a further embodiment of the present invention (not shown) both the opposite planar surfaces of a strip of carrier material are coated with said wear-resistant coating. By performing a subsequent machining operation in order to obtain a bevelled surface of the thus coated strip, such bevelled surface extending from one of said opposite surfaces of the strip to the other obliquely with respect to said surfaces, a doctor blade is provided with a bevelled surface having a hard entry part provided by said wear-resistant material on one surface of the strip, a soft central part provided by the exposed carrier material and an exit part provided by said wear-resistant coating on the opposite said surface of the strip.

The wear-resistant material may comprise one or more metals, cermets, ceramic materials, metal oxides and/or metal carbides, either alone or in combination.

Special precautions are taken to prevent strip 1 from being sufficiently heated by the material deposited, while the coating is being built up, to cause distortion of the strip or alteration of its physical properties. Such heating is a real risk because, due to its low heat capacity, the thin strip of carrier material used can very quickly absorb so much heat that the temperature limit before a change in material properties occurs, is exceeded.

The heat quantity applied per unit time in the spraying of the wear-resistant material is relatively constant for a given capacity and setting of the spraying unit. The stepwise build-up of the coating proposed according to the invention is effected by applying several extremely thin layers in thicknesses of 0.002–0.04 mm one on top of the other to form the total coating, which should have a total thickness of 0.05–0.35 mm. Practical experiments have shown that the thickness of individual layers should preferably not exceed 10% of the thickness of the carrier material.

The strip material is passed through the coating station at such a speed in relation to the capacity of the coating unit that the heat supplied to the carrier material by each coating layer is so slight in relation to the thermal capacity of the carrier material that the temperature increase in the carrier material does not cause any change in the physical properties of the carrier material. The heat thus applied in each coating step to the carrier material can be removed therefrom before the next coating step, for example by normal heat loss to the environment. If desired, an additional cooling effect can be achieved by bringing the strip-shaped carrier material into mechanical contact with a cooled roller surface during its passage over the rotating roller. Cooling can be effected, for instance, by supplying the roller 5 with coolant internally. Of course, the carrier material can also be subjected to cooling by the direct supply of coolant, for instance by the use of liquid carbon dioxide or by extra air cooling should natural cooling of the carrier material be insufficient.

The apparatus shown in FIG. 1 was run in the following manner:

A steel strip of tempered carbon steel with a thickness of 0.305 mm and strip width of 76 mm was used as carrier material. The steel strip was wound in rolls of 400 m. A plasma unit was used for coating. In the first case only one strip of carrier material was run through the equipment, which was operated so that the strip passed in the direction of arrow 3, with the roller 9 driving and the roller 8 braking. Pre-treatment was carried out by a soft, flexible, rotating grinding wheel comprising radially projecting emery cloth. This pretreatment was performed the first time the material passed through the equipment. The nozzle of the plasma unit was located ca. 80 mm from the surface of the strip and the circular coating zone had a diameter of about 12 mm. This resulted in a coating 8 mm wide along the strip of carrier material. The layer thickness of the first coating step was estimated to be 0.01 mm and the strip speed was 40 m/min. No discolouring of the coated strip, nor deformation due to heat could be detected and there had obviously been no local overheating of the strip. The total time for the fist passage of the strip through the coating means was ca. 10 minutes. After renewing the coating powder in the spray unit, a second coating layer was applied by reversing the direction of rotation of the drive rollers and adjusting them so that the strip and the rotating roller were driven by the roller 8—with the roller 9 braking. An improvement in the coating in the pre-treated surface layer could be achieved in some cases if a layer of binder was applied as the first layer. The strip speed was ca. 40 m/min and the thickness of layers applied subsequently was about 0.01 mm. The strip temperature remained substantially the same as at its first passage through the coating station. After another fifteen passages of the strip through the coating station, the total thickness of the coating was 0.150 mm.

The strip thus coated was then ground to a surface finish of about 0.5 $\mu$ $R_a$, after which the strip was cut into suitable lengths.

The final grinding of the coating surface to a finish of less than 3.0 $\mu$ $R_a$ is preferably achieved by means of a diamond grinding wheel, the grinding surface having particles with a particle size not exceeding 0.1 mm, preferably within the range 0.01–0.05 mm, embedded in a suitable binder.

As mentioned above, the wear-resistant material used in the coating according to the invention may suitably consist of cermets, metal oxides or metal carbides. However, in the case of paper-coating scrapers, the scraper-coating material most suitable for each specific purpose may have to be selected taking into account, for instance, the quality of paper-coating desired. Although certain coating materials, such as chromium oxide, for instance, offer good wear-resistance, it has been noted that there may be a slight deterioration in the coating performance after some time in use.

Surprisingly, blade-coatings consisting primarily of alumina have proved to be particularly suitable for manufacturing scrapers giving high-quality paper-coating required for some purposes. Particularly good results have been achieved using blade-coatings of alumina ($Al_2O_3$) with a small quantity of some other metal oxide, such as titanium oxide ($TiO_2$).

In a variant, not shown, the strip 1 is passed successively through a plurality of coating stations, each with a respective coating unit, so that a plurality of coating layers are applied during each pass of the strip, or possibly all the coating stations are provided.

In such a variant, the strip is cooled after passing from each coating station and before passing to the next, so that it is not allowed to become too hot.

Figure 7:
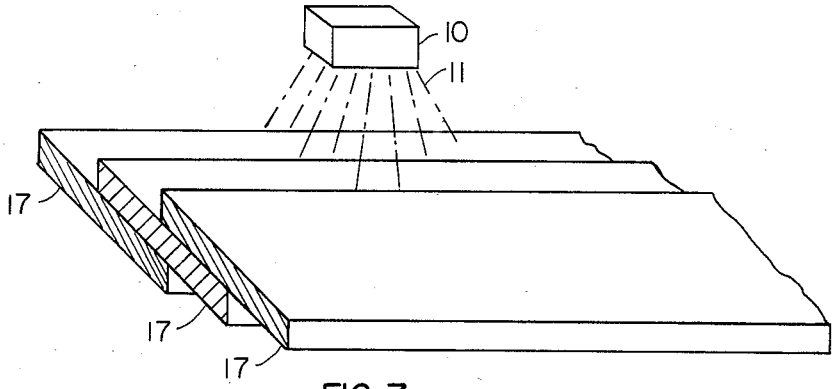
FIG. 7 is a schematic representation of an alternative embodiment of the present invention wherein a plurality of overlapping strips are simultaneously coated.

In a further variant of the invention two or more strips may be coated with wear-resistant material simultaneously by arranging the strips in superimposed face-to-face relationship but with the or each strip above the lowest being off set laterally, in the same direction, with respect to the strip below to expose the region of the upper face of the strip below, adjacent the respective edge of the strip below, being the region of the strip below to be coated, and by then passing the strips, thus superimposed, through the coating station to spray wear-resistant coating onto the exposed edge portions of the upper faces of the strips simultaneously. This is shown schematically in FIG. 7. The terms above, below, upper etc. are not, of course, intended to limit this variant to any particular orientation but are used simply for clarity.

The following experiments with scrapers manufactured in accordance with the invention confirm the desired improvement over conventional scrapers achieved.

EXPERIMENT 1

A blade manufactured in accordance with the invention, with a wear-resistant surface coating of alumina and titanium oxide was used for coating a wood-free printing paper. Th web speed was 500 m/min and the coating composition used was a water dispersion of 20% kaolin and 80% calcium carbonate.

The blade could be used for 30 hours with good coating result.

A conventional coating blade without a coating used under equivalent conditions, had to be changed after 4 hours running.

EXPERIMENT 2

A blade manufactured in accordance with the invention, with a wear-resistant coating of aluminia, was used for coating a wood-free paper with a coating composition based on a water dispersion of pigment. The web speed was 400 m/min. The blade gave a perfectly satisfactory coating result over a period of 60 hours.

A control experiment using a conventional blade without a wear-resistant coating showed that this conventional scraper must be replaced after a running time of 8 hours.

EXPERIMENT 3

A blade manufactured in accordance with the invention, having a wear-resistant coating of aluminia was used to manufacture creped tissue in a Yankee machine. The blade of spring steel was 1.2 mm thick, and had a coating 10 mm wide and 0.200 mm thick. The width of the stip was 3 m and its speed of travel was 900 m/min. The blade inserted in the blade holder of the paper machine, produced a perfectly satisfactory creping result for over 10 hours.

Even with the wear-resistant coating, scrapers or blades manufactured from strip-shaped material coated as described with reference to the drawings have substantially the same flexibility as the uncoated carrier material and a perfectly satisfactory coating result is thus guaranteed. The step-wise building up of the very thin surface coating as proposed, ensures good flexibility and minimum brittleness in the coating layer itself.

I claim:

1. A method of applying a wear-resistant coating to at least one strip of metallic carrier material, the method including the steps of providing a coating apparatus having at least one coating zone therein, and at least one spraying unit at said coating zone, for spraying a molten coating agent, which, when hardened, is wear-resistant, the method further comprising subjecting the strip to a plurality of successive coating steps in each of which the strip is passed longitudinally through said coating zone to be sprayed continuously within said coating zone with a molten coating agent, the method including the step of cooling the strip between successive coating steps to remove from the strip substantially all of the heat applied in the preceding coating step by the spraying of the molten coating agent, before the next said coating step, and wherein the heat applied to the strip, in each said coating step, is so small, in relation to the heat capacity of the strip, that the temperature increase in the strip is insufficient to change the physical properties of the carrier material, all of said coating steps being carried out in a single said coating zone, and in which said strip is passed alternately backwards and fowards through the coating zone, each said coating step being carried out during a respective pass through the coating zone.

2. A method according to claim 1 wherein, prior to said coating steps, the portion of the zone of the strip to be coated is subjected to a preparatory surface treatment.

3. A method according to claim 2, in which the preparatory surface treatment is performed by brushing with steel brushes.

4. A method according to claim 2, in which the preparatory surface treatment is performed by blasting with an abrasive having a grain size less than 0.2 mm.

5. A method according to claim 1, in which the thickness of the layer of coating agent applied to the strip in each said coating step does not exceed one tenth of the thickness of the strip of carrier material.

6. The method of claim 1 wherein the thickness of each layer of wear-resistant coating applied during each coating step is within a range of 0.002–0.04 mm.

7. A method according to claim 1, in which the strip has a maximum thickness of 2.0 mm, and said wear-resistant coating is applied in said coating steps to a total thickness of no more than 0.35 mm.

8. A method according to claim 7 in which, after said coating steps, the surface of the coating is given a finish of less than 3.0 $\mu R_a$, at least partially by grinding.

9. A method according to claim 1, in which during and/or between successive coating steps, the carrier material is cooled by being brought into direct contact with a cooling medium.

10. A method according to claim 1, in which the molten coating agent is applied by plasma-spraying.

11. A method according to claim 1, in which two strips of metallic carrier material are passed longitudinally through said coating zone simultaneously, the two strips being arranged parallel with one another, edge to edge.

12. A method according to claim 1, in which the coating agent is selected from the group consisting of metals, ceramics, cermets, metal oxides and metal carbides.

13. A method according to claim 12, in which the coating is formed of alumina.

14. A method according to claim 13, in which the coating is formed of a mixture of alumina with a relatively small quantity of another metal oxide.

15. A method according to claim 1, in which a plurality of strips of carrier material are arranged in face-to-face superimposed relationship but offset progressively laterally with respect to one another to expose a respective surface portion, adjacent a respective edge, of each strip, and the strips thus superimposed are passed longitudinally through the coating zone, to pass said exposed edge portions through said coating zone to be coated with wear-resistant material, during each said coating step.

16. A method according to claim 1, in which during each pass through the coating zone, the strip passing into the coating station and the strip passing therefrom is respectively delivered from and taken up on, respective reels, the direction of rotation of each reel being reversed between successive passes so that the reel which acts as take-up reel in one pass acts as delivery reel in the next, and vice versa.

17. A method according to claim 1, wherein said wear-resistant coating is applied to a major surface of said strip at least in the area adjacent an edge surface thereof.

18. A method according to claim 1, wherein said coating material is applied to both major surfaces of said strip.

19. A method of applying a wear-resistant coating to a strip of metallic carrier material, the method including the steps of providing a coating apparatus having at least one coating station with a coating zone therein, and at least one spraying unit for spraying a molten coating agent, which, when hardened, is wear-resistant, at said coating zone, the method further comprising subjecting the strip to a plurality of successive coating steps in each of which the strip is passed longitudinally through said coating zone to be sprayed continuously within said coating zone with a molten coating agent, the method including the step of cooling the strip between successive coating steps to remove from the strip substantially all of the heat applied in the preceding coating step by the spraying of the molten coating agent, before the next said coating step, and wherein the heat applied to the strip, in each said coating step, is so small, in relation to the heat capacity of the strip, that the temperature increase in the strip is insufficient to change the physical properties of the carrier material, said coating of wear-resistant material being applied in a band extending along the middle of said strip and, after said coating steps, said strip being slit longitudinally along its middle into two sub-strips each having a region, adjacent a respective edge coated with said wear-resistant material.

20. A method according to claim 19, in which the strip, prior to the coating steps, is provided with a longitudinal V-section groove located intermediate its edges and wherein, in said coating steps, said wear-resistant coating agent is applied over a longitudinally extending coating area including said groove, and wherein, after said coating steps, the strip is split longitudinally along the bottom of said grove to provide two sub-strips each having coated a bevel edge portion as well as an adjoining coated portion of one of the two major surfaces of the strip.

21. A method of applying a wear-resistant coating to a strip of metallic carrier material, the method including the steps of providing a coating apparatus having at least one coating station with a coating zone therein, and at least one spraying unit for spraying a molten coating agent, which, when hardened, is wear-resistant, at said coating zone, the method further comprising subjecting the strip to a plurality of successive coating steps in each of which the strip is passed longitudinally through said coating zone to be sprayed continuously within said coating zone with a molten coating agent, the method including the step of cooling the strip between successive coating steps to remove from the strip substantially all of the heat applied in the preceding coating step by the spraying of the molten coating agent, before the next said coating step, and wherein the heat applied to the strip, in each said coating step, is so small, in relation to the heat capacity of the strip, that the temperature increase in the strip is insufficient to change the physical properties of the carrier material, wherein the coating of wear-resistant material on said strip is limited to a portion of the width of said strip, and, between coating steps, the strip is wound on a reel, within an interlayer, in the form of a strip of material of substantial thickness, being applied continuously between the turns on the reel, said interlayer engaging the opposing surfaces of said wound strip only on said uncoated surfaces whereby said strip can be wound and unwound evenly on said reel.

22. A method of applying a wear-resistant coating to a strip of metallic carrier material, the method including the steps of providing a coating apparatus having at least one coating station with a coating zone therein, and at least one spraying unit for spraying a molten coating agent, which, when hardened, is wear-resistant, at said coating zone, the method further comprising subjecting the strip to a plurality of successive coating steps in each of which the strip is passed longitudinally, through said coating zone to be sprayed continuously within said coating zone with a molten coating agent, the method including the step of cooling the strip between successive coating steps to remove from the strip substantially all of the heat applied in the preceding coating step by the spraying of the molten coating agent, before the next said coating step, and wherein the heat applied to the strip, in each said coating step, is so small, in relation to the heat capacity of the strip, that the temperature increase in the strip is insufficient to change the physical properties of the carrier material, a plurality of strips of carrier material being arranged in face to face superimposed relationship but offset progressively laterally with respect to one another to expose a respective surface portion, adjacent a respective edge, of each said strip, and said strips thus superimposed being passed longitudinally through said coating zone, to pass said exposed edge portions through said coating zone to be coated with wear-resistant material, during each said coating step.

* * * * *